US005342224A

United States Patent [19]

Lefavour

[11] Patent Number: 5,342,224

[45] Date of Patent: Aug. 30, 1994

[54] PARALLEL STREET LIGHT TAP CONNECTOR

[75] Inventor: John Lefavour, Litchfield, N.H.

[73] Assignee: Burndy Corporation, Norwalk, Conn.

[21] Appl. No.: 158,039

[22] Filed: Nov. 19, 1993

Related U.S. Application Data

[63] Continuation of Ser. No. 982,411, Nov. 27, 1992, abandoned, which is a continuation of Ser. No. 792,110, Nov. 14, 1991, abandoned.

[51] Int. Cl.[5] ..... H01R 4/44

[52] U.S. Cl. ..... 439/781

[58] Field of Search ..... 439/781, 782, 790, 791, 439/794

[56] References Cited

U.S. PATENT DOCUMENTS

| | | | |
|---|---|---|---|
| 1,699,211 | 1/1929 | Rose | 439/781 |
| 2,053,615 | 9/1936 | Krueger | 439/781 X |
| 2,679,032 | 5/1954 | Thomas, Jr. et al. | 439/781 |
| 2,712,167 | 7/1955 | Blanchard | 24/569 |
| 2,963,679 | 12/1960 | Jugle | 439/781 |
| 3,026,497 | 3/1962 | Myers et al. | 439/781 |
| 4,169,652 | 10/1979 | Höckele et al. | 439/781 |
| 4,684,196 | 8/1987 | Smith et al. | 439/781 X |
| 4,707,051 | 11/1987 | Hall | 439/781 |
| 4,985,003 | 1/1991 | Francois et al. | 439/781 |

*Primary Examiner*—Gary F. Paumen

*Attorney, Agent, or Firm*—Mitchell B. Wasson; Martin P. Hoffman; Burtsell J. Kearns

[57] ABSTRACT

A tap connector provided with upper and lower body portions, each of the body portions including opposed concave seating surfaces adapted to hold a conductor having a first diameter. The upper and lower portions are provided with a tongue and groove combination parallel to the concave seating surfaces to hold a conductor having a second diameter less in size than the first diameter. This tongue and groove combination provides an anti-rotating feature.

2 Claims, 2 Drawing Sheets

PARALLEL STREET LIGHT TAP CONNECTOR

This is a continuation of copending application Ser. No. 07/982,411, filed on Nov. 27, 1992, now abandoned, which is a continuation of Ser. No. 07/792,110, filed on Nov. 14, 1991, now abandoned.

FIELD OF THE INVENTION

The present invention is directed to a tap connector for clamping two wire conductors together.

BACKGROUND OF THE INVENTION

Numerous tap connectors have been developed in which two wire conductors are connected together. Examples of these tap connectors are illustrated in U.S. Pat. Nos. 1,699,211 issued to Rose; 2,053,615 issued to Krueger; 2,712,167 issued to Blanchard; 2,963,679 issued to Jugle; 4,169,652 issued to Hockele et al; 4,684,196 issued to Smith et al; 4,707,051 issued to Hall and 4,985,003 issued to Francois et al. While the majority of these patents are directed to tap connectors for connecting two conductors having equal diameters, the patents to Krueger, Blanchard and Smith et al are directed to connectors in which conductors having an unequal diameter are clamped together. Typically, these conductors are provided with top and body portions which are clamped together utilizing a bolt as a fastening member. The top and bottom body portions of these clamps are each provided with opposed concave seats for positioning the cables or conductors therein. However, due to the unequal geometries of the conductors or cables, i.e. the unequal diameters, it is difficult to adequately and securely clamp these conductors having unequal diameters together.

SUMMARY OF THE INVENTION

The present invention overcomes the deficiencies of the prior art by providing a tap connector for connecting together two conductors or cables having unequal diameters. The tap connector includes an upper and lower body portion, each body portion provided with an opposed concave seat for seating a conductor having a first diameter therebetween. A tongue and groove configuration is additionally provided in the upper and lower body portions for seating a cable or conductor having a second diameter, less than the first diameter therebetween. This particular design would allow conductors or cables having unequal diameters to be positively seated and maintained in the tap connector.

BRIEF DESCRIPTION OF THE DRAWINGS

These and other objects of the present invention will become apparent from the following description taken in conjunction with the drawings, in which.

DETAILED DESCRIPTION OF THE INVENTION

Figure 1:
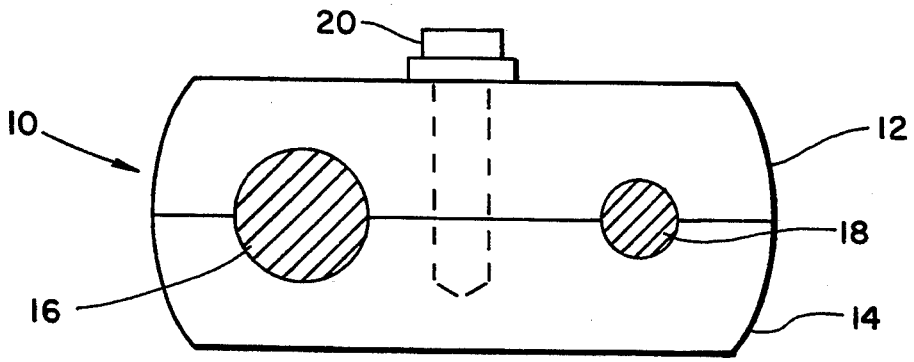
FIG. 1. (PRIOR ART)
FIG. 1 is a side view of a prior art tap connector.

FIG. 1 illustrates a typical prior art tap connector 10 including a top body portion 12, a bottom body portion 14, each body portion provided with two pairs of concave seats to accommodate two conductors 16,18 within the clamp, each conductor having a diameter unequal to its paired conductor. A bolt 20 is used to connect the upper and lower body portions together.

Figure 2:
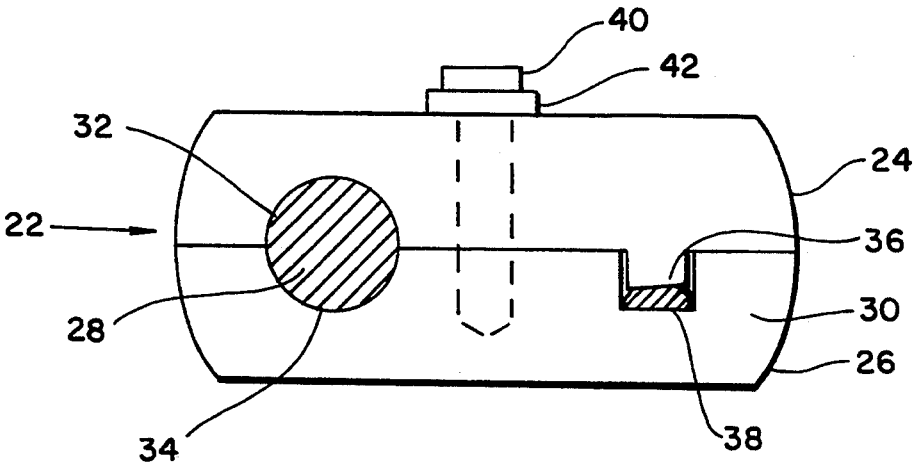
FIG. 2 is a side view of the tap connector according to the present invention.
Figure 3:
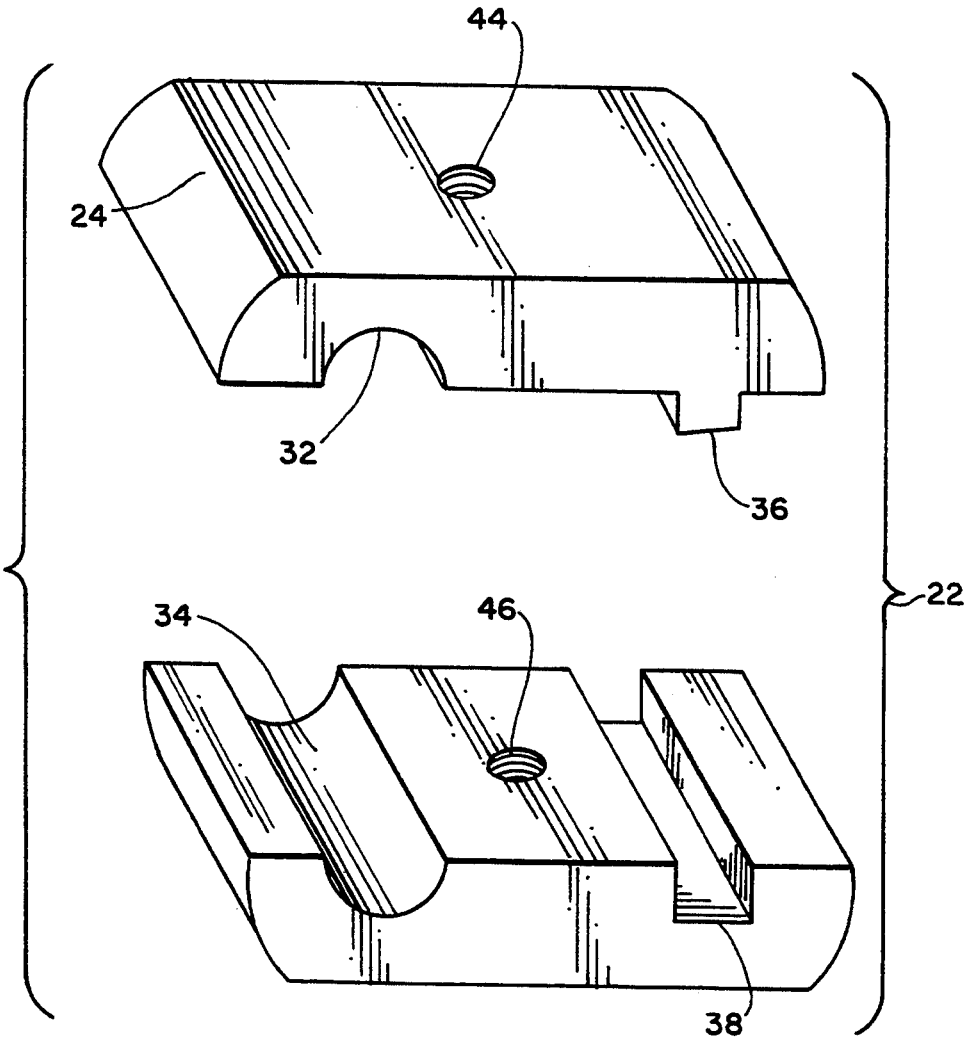
FIG. 3 is a perspective view of the two body portions of the tap connector according to the present invention.

The tap connector of the present invention is particularly illustrated with respect to FIGS. 2 and 2. This tap connector 22 includes an upper body portion 24, and a lower body portion 26 to accommodate therebetween a first conductor 28 having a first diameter and a second conductor 30 having a second diameter less than the first diameter. The upper body portion 24 includes a top concave surface 32, and the lower body portion 26 is provided with an opposed concave surface 34 allowing the conductor 28 to be provided therebetween. Both concave surfaces extend for substantially the entire width of their respective body portions. The upper body portion additionally includes a tongue 36 extending for the entire width of the upper body portion 24. The lower body portion 26 is provided with a groove 38 extending for the entire width of the lower body portion 26 opposed to the tongue portion 36. Therefore, when a bolt 40 and washer 42 are used to secure the upper body portion 24 to the lower body portion 26, the tongue 36 and the groove 38 are interlocked, thus preventing the upper body portion or the lower body portion from rotating when the bolt is installed through hole 44 and tightened in threaded hole 46 in the body portions.

Figure 4:
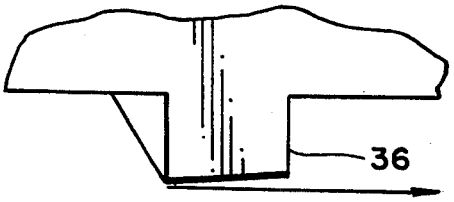
FIG. 4 is a blown-up view of the tongue portion of the present invention.

As shown in FIG. 4, the tongue 36 is not entirely perpendicular with respect to the groove 38 and contains a slight angle on its clamping surface. This angle compensates for upper body tilt associated with variations in large conductor diameter and helps to maintain constant contact pressure on the smaller diameter conductor. It has been found that this angle typically should be in the range of from zero to ten degrees, with an optimal angle of between three and five degrees. Generally, as the diameters of the conductors approach each other in size, the angle would decrease and would approach zero degrees. Conversely, as the difference in diameters of the conductors would increase, the angle of the tongue with respect to the horizontal would also increase.

Although it has been found that the present invention has particular utility in the power line environment, it can be utilized in any instance in which a connector is used to couple two conductors, each having a dissimilar diameter to each other. It is also noted that the upper body portion 24 and the lower body portion 26 can be formed by extruded aluminum, or in some situations by cast aluminum.

To those skilled in the art to which this invention relates, many changes in construction and widely differing embodiments and applications of the invention will suggest themselves without departing from the spirit and scope of the invention. The disclosure and the description herein are merely illustrative and are not intended to be in any sense limiting.

What is claimed is:

1. A tap connector for connecting and coupling two parallel conductors, one of said conductors having a first diameter and the second of the conductors having a second diameter less than the first diameter comprising:

an upper body portion provided with a bottom surface, a top surface and two end surfaces, said bottom surface provided with a top concave seat extending substantially the entire width of said bottom surface from said one end surface to said second end surface, said bottom surface further provided with a tongue member, parallel to and equal in length to said top concave seat, said tongue member provided with two side surfaces and a bottom planar surface extending completely between said two side surfaces of said tongue member, said bottom planar surface angled slightly with respect to the horizontal at a single constant angle for the entire distance between said two side surfaces of said tongue member;

a lower body portion provided with a top surface, a bottom surface and two end surfaces, said top surface of said lower body portion provided with a bottom concave seat extending substantially the entire width of said top surface from said one end surface to said second end surface of said lower body portion, said bottom concave seat opposed to said top concave seat, said top surface of said bottom portion additionally provided with a groove parallel to said bottom concave seat extending between said end surfaces of said bottom body portion opposed to said tongue member, said groove provided with two side surfaces and a bottom planar surface provided between said two side surfaces of said groove;

a fastening means for fastening said upper body portion to said lower body portion with the conductor having the first diameter provided between said top concave seat and said bottom concave seat, and the conductor having the second diameter provided between said tongue member and said groove; and wherein said groove and said tongue member acting to prevent rotation of said upper body, when said upper body is fastened to said lower body by said fastening means.

2. The tap connector in accordance with claim 1 wherein said single constant angle of said tongue member bottom planar surface is between zero and ten degrees.

* * * * *